US009074739B2

(12) United States Patent
Deighton et al.

(10) Patent No.: US 9,074,739 B2
(45) Date of Patent: Jul. 7, 2015

(54) FLASHLIGHT WITH MULTIPLE LIGHT SOURCES

(75) Inventors: Kevin Deighton, Long Beach, CA (US); Sukwon Kang, Torrance, CA (US); Laichang Tang, Chino Hills, CA (US)

(73) Assignee: PELICAN PRODUCTS, INC., Torrance, CA (US)

( * ) Notice: Subject to any disclaimer, the term of this patent is extended or adjusted under 35 U.S.C. 154(b) by 160 days.

(21) Appl. No.: 13/345,157

(22) Filed: Jan. 6, 2012

(65) Prior Publication Data

US 2013/0176713 A1 Jul. 11, 2013

(51) Int. Cl.

| | |
|---|---|
| ***F21L 4/02*** | (2006.01) |
| ***F21L 4/08*** | (2006.01) |
| ***F21L 4/00*** | (2006.01) |
| ***F21V 1/00*** | (2006.01) |
| *F21Y 101/02* | (2006.01) |

(52) U.S. Cl.

CPC ..... *F21L 4/027* (2013.01); *Y10T 29/49002* (2015.01); *F21L 4/02* (2013.01); *F21L 4/08* (2013.01); *F21L 11/00* (2013.01); *F21L 15/00* (2013.01); *F21L 15/02* (2013.01); *F21Y 2101/02* (2013.01)

(58) Field of Classification Search

USPC ..... 362/183, 184, 197, 199, 202, 205, 236, 362/247, 208

See application file for complete search history.

(56) References Cited

U.S. PATENT DOCUMENTS

| | | | | | |
|---|---|---|---|---|---|
| 1,330,974 | A | * | 2/1920 | Westerberg et al. | 362/184 |
| 1,423,911 | A | * | 7/1922 | Cardwell | 362/184 |
| 1,460,149 | A | * | 6/1923 | Barany | 362/184 |
| 1,613,203 | A | * | 1/1927 | Shannon | 362/184 |
| 1,661,785 | A | * | 3/1928 | Bruninga et al. | 362/184 |
| 1,832,443 | A | * | 11/1931 | Barany | 362/184 |
| 2,237,963 | A | * | 4/1941 | Hawks | 33/348 |
| 2,245,707 | A | * | 6/1941 | Packer | 362/184 |
| 2,358,820 | A | * | 9/1944 | Muldoon | 362/197 |
| 2,466,414 | A | * | 4/1949 | Gits et al. | 200/60 |
| 2,599,253 | A | * | 6/1952 | Gits | 362/208 |
| 3,809,321 | A | | 5/1974 | Rundberg | |
| 4,228,485 | A | * | 10/1980 | Hubbard et al. | 362/191 |
| 4,290,095 | A | * | 9/1981 | Schmidt | 362/191 |
| 5,077,644 | A | * | 12/1991 | Schaller et al. | 362/184 |
| 5,134,558 | A | * | 7/1992 | Williams et al. | 362/263 |

(Continued)

FOREIGN PATENT DOCUMENTS

| | | |
|---|---|---|
| CN | 1816716 | 8/2006 |
| DE | 2020060 14 273 U1 | 12/2006 |

(Continued)

OTHER PUBLICATIONS

Australian Examiner's Report, dated Apr. 13, 2013, from related Australian Patent Appln No. 2013200071.

(Continued)

*Primary Examiner* — Ismael Negron

(74) *Attorney, Agent, or Firm* — Foley & Lardner LLP

(57) ABSTRACT

A flashlight includes a housing for receiving a battery; a first light supported by the housing, the first light configured to emit light in a first direction; a second light supported by the housing, the second light configured to emit light in a second direction that is non-parallel with the first direction; and an actuation switch configured for selectively powering the first light and the second light with the battery received in the housing.

22 Claims, 10 Drawing Sheets

(56) References Cited

U.S. PATENT DOCUMENTS

| | | | | | |
|---|---|---|---|---|---|
| 5,357,411 | A * | 10/1994 | Menke et al. | 362/183 |
| 5,871,272 | A * | 2/1999 | Sharrah et al. | 362/184 |
| 5,993,022 | A * | 11/1999 | Neyer et al. | 362/199 |
| 6,017,129 | A * | 1/2000 | Krietzman | 362/184 |
| 6,161,938 | A * | 12/2000 | Kish et al. | 362/183 |
| 6,179,431 | B1 * | 1/2001 | Chien | 362/84 |
| 6,623,140 | B2 * | 9/2003 | Watterson et al. | 362/184 |
| 6,633,152 | B2 * | 10/2003 | Sharrah et al. | 320/114 |
| 6,752,514 | B2 * | 6/2004 | Parker | 362/183 |
| 7,229,189 | B2 * | 6/2007 | Parker et al. | 362/199 |
| RE40,027 | E * | 1/2008 | Matthews | 362/184 |
| 7,651,240 | B2 * | 1/2010 | Bayat et al. | 362/208 |
| 7,731,385 | B2 * | 6/2010 | Spartano et al. | 362/184 |
| 7,857,480 | B2 * | 12/2010 | Steele et al. | 362/197 |
| 2003/0179573 | A1 * | 9/2003 | Chun | 362/184 |
| 2003/0223227 | A1 * | 12/2003 | Levine | 362/183 |
| 2004/0090775 | A1 * | 5/2004 | Hsien | 362/184 |
| 2004/0141316 | A1 | 7/2004 | Twardawski | |
| 2005/0002186 | A1 | 1/2005 | Krieger et al. | |
| 2005/0047123 | A1 * | 3/2005 | Fujimoto | 362/184 |
| 2006/0133074 | A1 * | 6/2006 | Lai | 362/205 |
| 2008/0074869 | A1 * | 3/2008 | Okishima | 362/184 |
| 2008/0239711 | A1 * | 10/2008 | Seok | 362/157 |
| 2009/0261737 | A1 | 10/2009 | Wright et al. | |

FOREIGN PATENT DOCUMENTS

| | | |
|---|---|---|
| JP | 62-178401 | 8/1987 |
| JP | 3112736 | 5/1991 |
| JP | 3114446 | 5/1991 |
| JP | 3002131 | 7/1994 |
| JP | 2008-218182 | 9/2008 |
| JP | 2010-045008 | 2/2010 |
| JP | 2011-510185 | 3/2011 |
| JP | 2011-081999 | 4/2011 |
| WO | WO-2005/051605 A1 | 6/2005 |
| WO | WO-2011/105423 | 9/2011 |

OTHER PUBLICATIONS

European Search Report, dated Jun. 18, 2013, from related European Patent Appln No. 13150088.6.

Japanese Office Action from related Japanese patent application No. 2012-287125, received Dec. 11, 2013.

Australian Examiner's Report, dated May 6, 2014, from related Australian Patent Appln No. 2013200071.

Japanese Office Action, dated Mar. 25, 2014, from related Japanese patent application No. 2012-287125.

Chinese Official Action issued Sep. 3, 2014, from related Chinese patent application No. 201310003597.0.

Japanese Official Action issued Oct. 14, 2014, from related Japanese patent application No. 2012-287125.

* cited by examiner

| ITEM NO. | DESCRIPTION | QTY |
|---|---|---|
| 1 | MAIN HOUSING | 1 |
| 2 | SWITCH BOOT | 1 |
| 3 | 4-40 PAN HEAD SCREW X 1/2" L | 2 |
| 4 | #4 PAN HEAD SELF TAPPING SCREW, 1/2" L | 2 |
| 5 | CLIP | 1 |
| 6 | #4 FLAT HEAD TAPPING SCREW, 3/8" L | 1 |
| 7 | O-RING, HEADS-UP LIGHT | 1 |
| 8 | LED MODULE SUBASSEMBLY | 1 |
| 9 | REFLECTOR ASSEMBLY | 1 |
| 10 | VALVE, PUV | 1 |
| 11 | RED PUV COVER | 1 |
| 12 | DECAL | 1 |
| 13 | SHROUD | 1 |
| 14 | LENS | 1 |

| ITEM NO. | DESCRIPTION | QTY. |
|---|---|---|
| 201 | LED MODULE ASSEMBLY | 1 |
| 202 | BATTERY COVER ASSEMBLY | 1 |

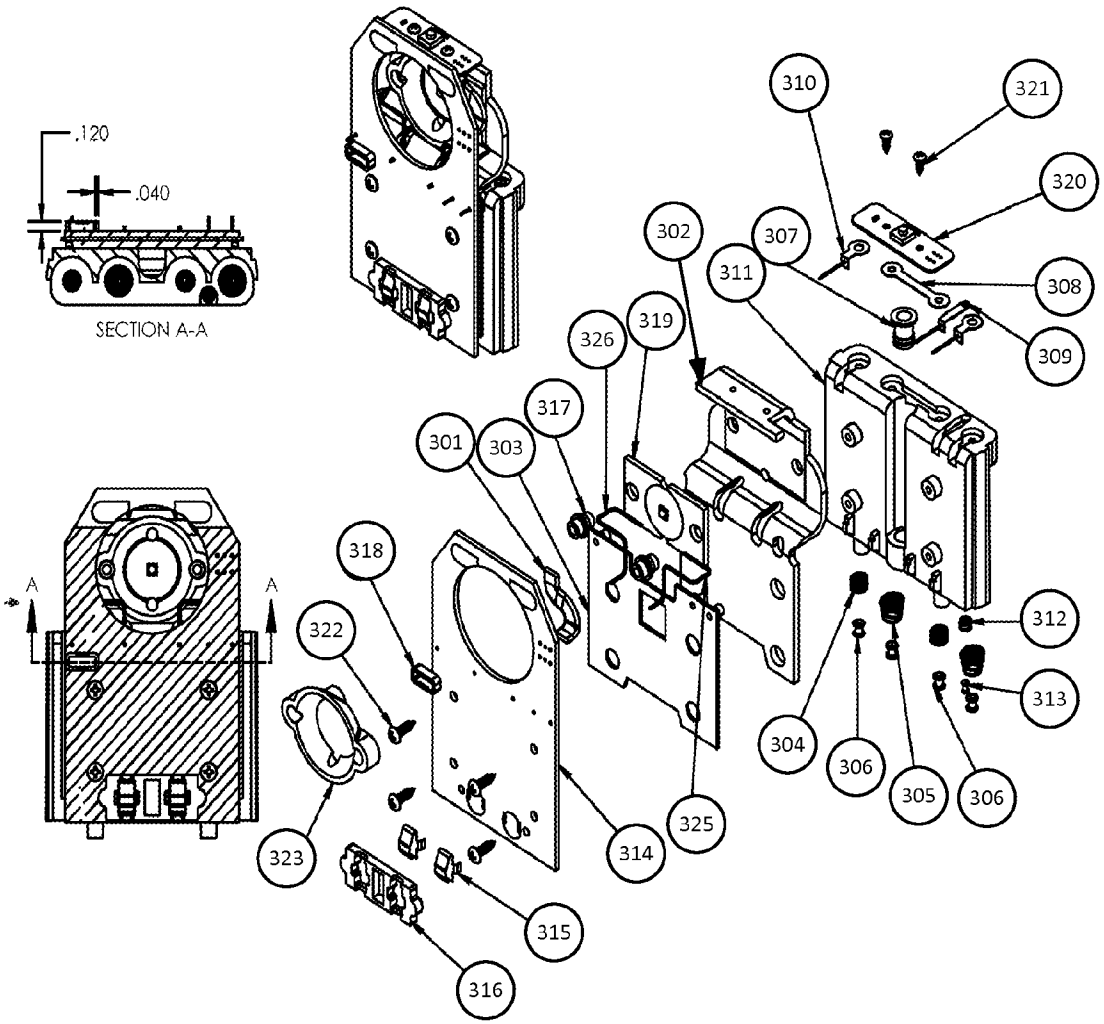

| ITEM NO. | DESCRIPTION | QTY |
|---|---|---|
| 301 | WIRE, MAIN PCB TO SWITCH PCB | 1 |
| 302 | HEAT SINK | 1 |
| 303 | MAIN SPACER | 1 |
| 304 | POS CONTACT SPRING | 2 |
| 305 | NEG CONTACT SPRING | 2 |
| 306 | EYELET BATTERY CONTACT | 4 |
| 307 | M5 INSERT | 1 |
| 308 | CONTACT JUMPER, SPACER | 1 |
| 309 | CHARGING CONTACT JUMPER | 1 |
| 310 | BATTERY CONTACT JUMPER | 2 |
| 311 | BATTERY SPACER | 1 |
| 312 | CONTACT SPRING, NiMH | 1 |
| 313 | EYELET, NiMH SIGNAL | 1 |
| 314 | MAIN PCB | 1 |
| 315 | CHARGING CONTACT | 1 |
| 316 | CONTACT PROTECTOR | 1 |
| 317 | MCPCB RETAINING RING | 2 |
| 318 | FUSE HOLDER | 1 |
| 319 | MCPCB W/LED | 1 |
| 320 | SWITCH PCBA | 1 |
| 321 | #2 PAN HEAD SELF TAPPING, 1/4" L | 2 |
| 322 | #4 PAN HEAD SELF TAPPING, 3/8" L | 4 |
| 323 | REFLECTOR HOLDER | 1 |
| 324 | BUSS WIRE | 3 |
| 325 | MCPCB NEGATIVE WIRE | 1 |
| 326 | MCPCB POSITIVE WIRE | 1 |

FIG. 7C

SECTION A-A

| ITEM NO. | DESCRIPTION | QTY. |
|---|---|---|
| 401 | KNOB, BATTERY COVER | 1 |
| 402 | BATTERY COVER | 1 |
| 403 | TOP BATTERY COVER | 1 |
| 404 | THREADED STUD | 1 |
| 405 | STEEL BRAIDED TETHER | 1 |
| 406 | BATTERY SPRING | 2 |
| 407 | POLARITY SPACER | 2 |
| 408 | RETAINING RING (FIT 3/16 ID) | 1 |
| 409 | O-RING | 1 |
| 410 | O-RING KNOB | 1 |
| 411 | EYELET | 2 |
| 412 | INSERT | 1 |

FLASHLIGHT WITH MULTIPLE LIGHT SOURCES

BACKGROUND

The present disclosure generally relates to the field of flashlights. The present disclosure relates more specifically to flashlights including multiple lights.

SUMMARY

A flashlight includes a housing, a first light, a second light, and an actuation switch. The housing is for receiving a battery. The first light is supported by the housing. The first light is configured to emit light in a first direction. The second light is supported by the housing. The second light is configured to emit light in a second direction that is non-parallel with the first direction. The actuation switch is configured to selectively powering the first light and the second light with the battery received in the housing.

In various embodiments, the second direction is oblique to the first direction.

In various embodiments, the second direction is angled between zero and 180 degrees, exclusive, to the first direction. In some embodiments, the second direction is angled at 45 degrees to the first direction. In some embodiments, the first direction extends along a longitudinal dimension of the housing. In some embodiments, the first direction is substantially parallel to ground level. In some embodiments, the second direction is a forward direction from the housing. The first direction is a downward direction.

In various embodiments, at least one of the first light and the second light comprises one or more light emitting diodes.

In various embodiments, the second light comprises a plurality of lights.

In various embodiments, the second light is arranged to face in the second direction.

In various embodiments, the actuation switch is configured for selecting a mode of operation for the flashlight. In some embodiments, in a first mode each of the first light and the second light emit light. In a second mode, only one of the first light and the second light emit light. In some embodiments, the actuation switch is arranged above the first light and the second light.

In various embodiments, the housing includes a reflector assembly in which the second light is received. In some embodiments, the first light is received in the reflector assembly. In some embodiments, the reflector assembly is arranged within the housing.

In various embodiments, the flashlight is a right-angle flashlight.

In various embodiments, the flashlight further includes a fastening member coupled to the housing for fastening the flashlight to a user.

In various embodiments, the flashlight further includes a charging unit for charging the flashlight.

A method of manufacturing a flashlight includes (but is not limited to any one or combination of): (i) providing a housing for receiving a battery; (ii) arranging a first light to be supported by the housing, the first light configured to emit light in a first direction; (iii) arranging a second light to be supported by the housing, the second light configured to emit light in a second direction transverse to the first direction; and (iv) configuring an actuation switch for selectively powering the first light and the second light with the battery received in the housing.

A flashlight includes a housing, a first light, a second light, and an actuation switch. The housing is for receiving a battery. The first light is supported by the housing for emitting light in a first direction. The second light is supported by the housing for emitting light in a second direction that is non-parallel with the first direction. The actuation switch is configured to selectively powering the first light and the second light with the battery received in the housing.

BRIEF DESCRIPTION OF THE FIGURES

FIGS. 7A-D are schematic diagrams of a flashlight according to various embodiments of the disclosure.

DETAILED DESCRIPTION OF THE EXEMPLARY EMBODIMENTS

Before turning to the figures, which illustrate the exemplary embodiments in detail, it should be understood that the application is not limited to the details or methodology set forth in the description or illustrated in the figures. It should also be understood that the terminology is for the purpose of description only and should not be regarded as limiting.

Referring generally to the figures, a flashlight is shown and described that includes two sets of lights. The first set of lights is a high-intensity light that shines forward from the flashlight. The light may be a high-intensity light emitting diode (LED) according to some embodiments. The second set of lights may be multiple lights (downcast lights) that emit light downwards from the flashlight to illuminate a pathway for a user of the flashlight. The second set of lights may be, for example (but not limited to), three LEDs angled at 45 degrees downwards from the flashlight according to some embodiments.

In various embodiments, the flashlight may be used as a firefighter light. The firefighter light is configured to emit or otherwise provide a firefighter with light in a forward direction and a downward direction to allow the firefighter to see directly in front of him or her (e.g., a door, wall, etc.) and the floor in front of him or her. In other embodiments, the flashlight may be used in any situation in which illumination forward and of the pathway forward is desirable. In some embodiments, the flashlight may include a clip that allows the flashlight to clip onto clothing (e.g., a coat of a firefighter around the chest area or the like).

Figure 1:
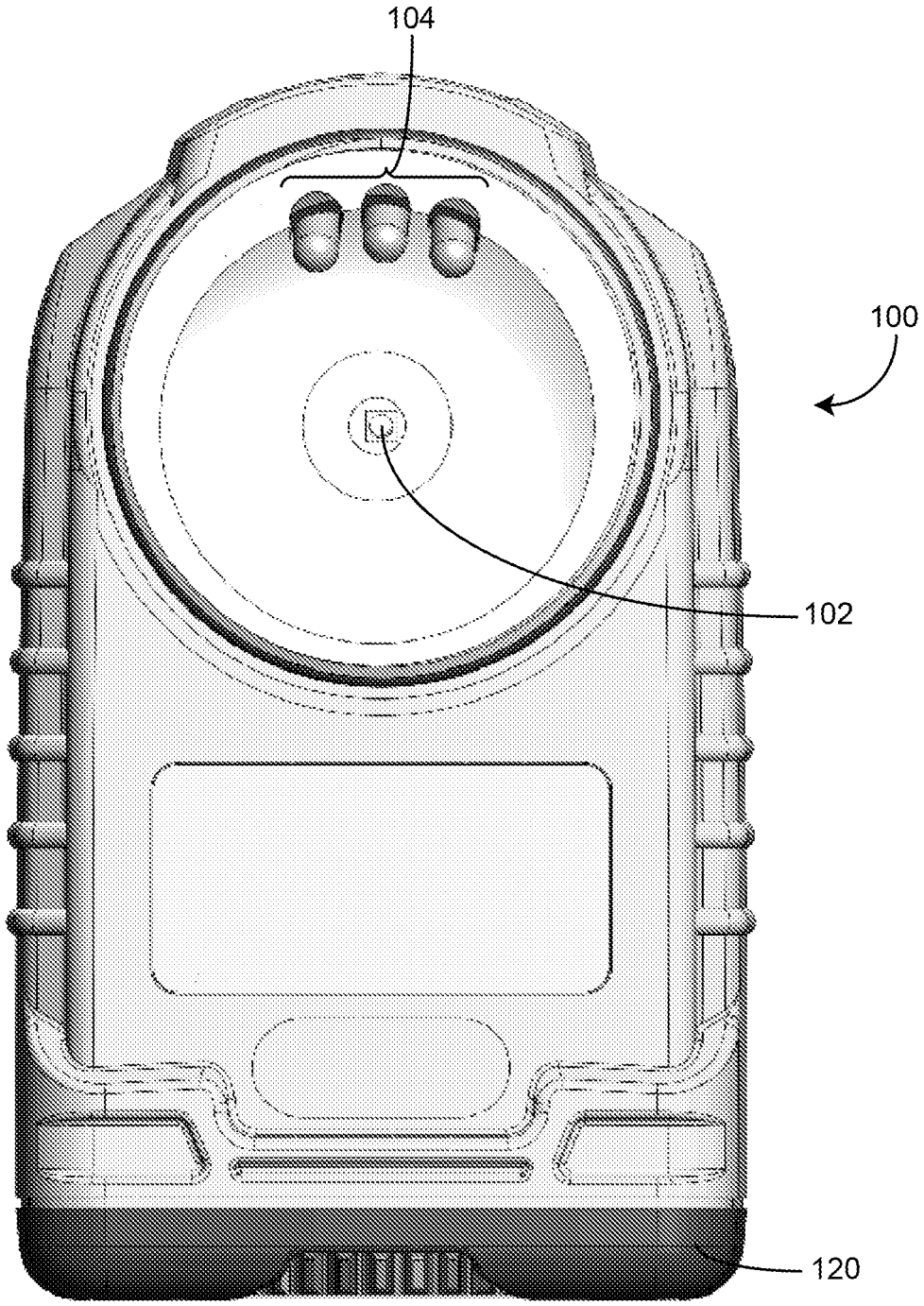
FIG. 1 is a front view of a flashlight according to various embodiments of the disclosure.

Referring to FIG. 1, a front view of a flashlight 100 is shown. Flashlight 100 includes a light 102. In some embodiments, the light 102 is a high-intensity light emitting diode (LED). The light 102 provides a main light source for the flashlight 100. The light 102 is configured to emit light in a generally forward direction. In particular embodiments, the light 102 may be a high-intensity light able to shine forward through smoke, fog, and other limited visibility situations. In particular embodiments, the flashlight 100 is a right-angle flashlight (e.g., a flashlight having a light (102) at a right angle relative to the housing of the flashlight).

The flashlight 100 further includes a set of lights 104. The lights 104 are arranged to emit light downwards at an angle relative to the light 102. That is, light emitted by the lights 104 is non-parallel to (or oblique to) light emitted by the light 102. By emitting light downwards at an angle, the lights 104 provide a user with a view of the pathway ahead of the user in limited visibility situations. In particular embodiments, the lights 104 may emit light downwards at a 45-degree angle. According to other embodiments, the lights 104 may emit light downwards at other angles (e.g., 30 degrees, 60 degrees, etc.). In some embodiments, the angle of the lights 104 (and/or the direction of the light emitted by the lights 104) may be set when the flashlight 100 is assembled. In other embodiments, the lights 104 (and/or the direction of the light emitted by the lights 104) may be configured for movement such that the angle of the lights 104 (and/or the direction of the light emitted by the lights 104) may be adjusted by a user.

In FIG. 1, the lights 104 are shown coupled to a top portion of the flashlight 100 and pointing downwards. For example, the lights 104 may be arranged in a reflector assembly, which may be the same reflector assembly in which the light 102 is arranged. In other embodiments, the lights 104 may be installed elsewhere on the flashlight 100 while still pointing downwards from the flashlight 100. In other embodiments, the lights 104 are arranged to emit light downwards from the flashlight 100 irrespective of the direction in which the lights 104 point. For example, a reflective surface or other component may be arranged to direct light emitted by the lights 104 downwards from the flashlight 100.

In some embodiments, light emitted by the lights 104 intersect light emitted by the light 102. Thus, according to some embodiments, light emitted by the lights 104 is at an angle between 0 and 180, exclusive, to light emitted by the light 102. In such embodiments, for example, the lights 104 (or component directing the light emitted by the lights 104) may be arranged above the light 102. In other embodiments, light emitted by the lights 104 do not intersect light emitted by the light 102 (when both the lights 104 and the light 102 are on). In such embodiments, for example, the lights 104 (or component directing the light emitted by the lights 104) may be arranged below the light 102 and/or at another location (e.g., to the side of the light 102) at which the light emitted by the light 104 does not intersect the light emitted by the light 102.

In FIG. 1, the lights 104 are shown as three LEDs that are arranged to emit light downwards from the flashlight 100. In other embodiments, the lights 104 may include more or less than three LEDs (e.g., one LED, four LEDs, etc.).

While the present embodiments illustrate LED lights for use with the flashlight, it should be understood that any type of light source can be used. For example, a xenon bulb may be used as the light-emitting source instead of LEDs for one or more of the light 102 and the lights 104.

Figure 2:
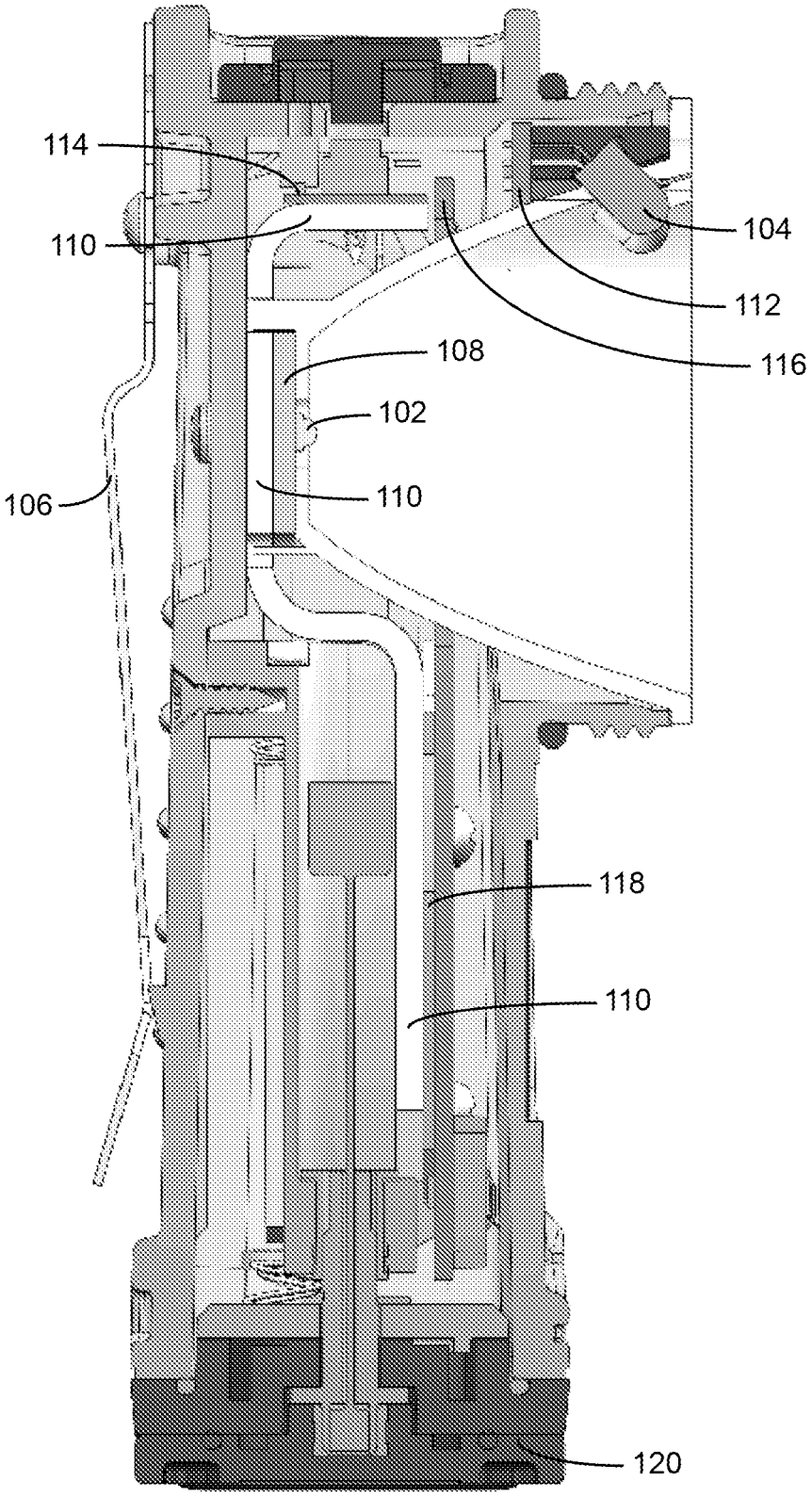
FIGS. 2-3 are cross-section views of a flashlight according to various embodiments of the disclosure.
Figure 3:
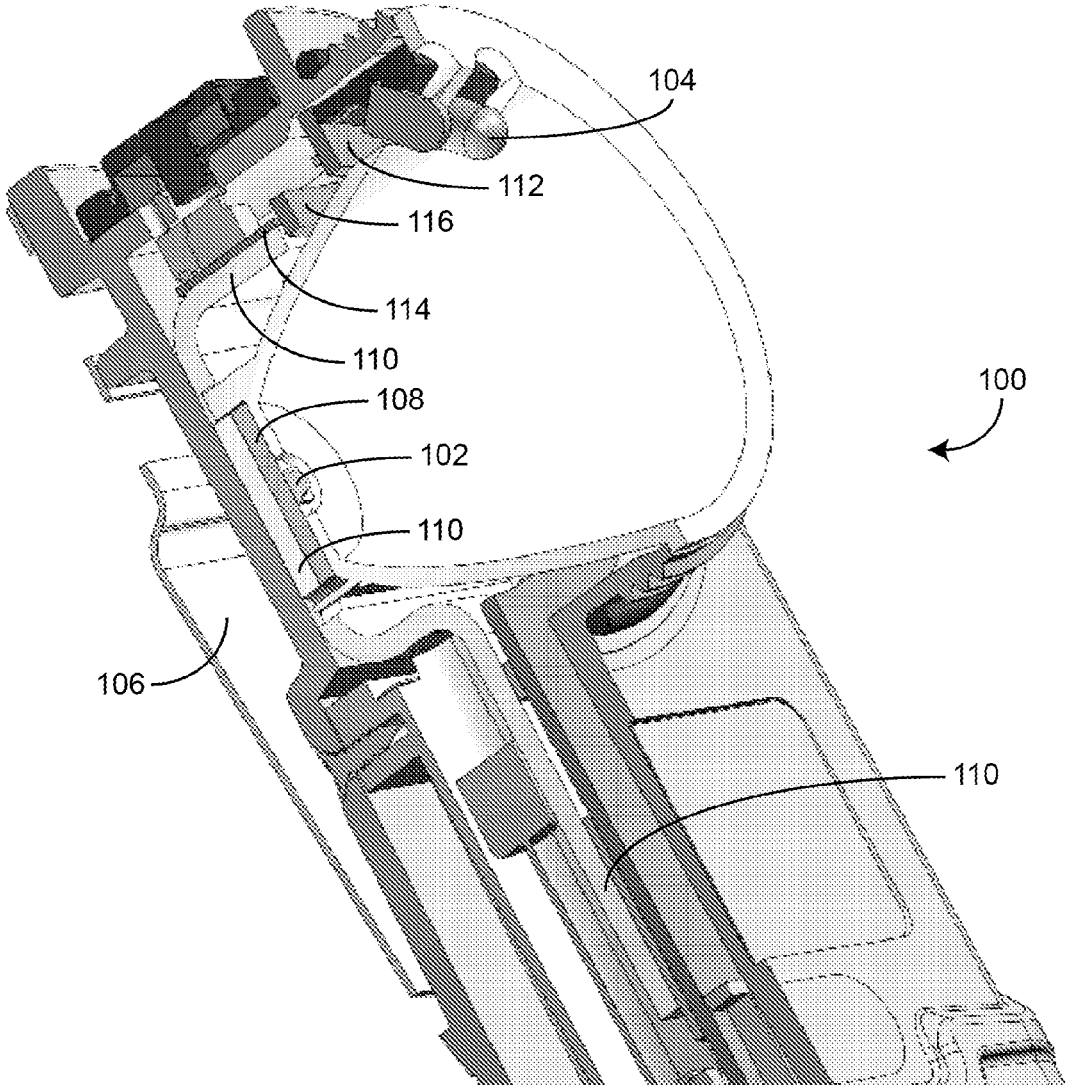

Referring now to FIGS. 2-3, a cross section view of the flashlight 100 is shown. The light 102 is shown as an LED and the lights 104 are shown as LEDs mounted to the top portion of the flashlight 100 pointing downwards to provide illumination for a pathway below.

In some embodiments, the flashlight 100 further includes a clip 106. The clip 106 allows the flashlight 100 to be fastened to a user's clothing (e.g., a firefighter's coat, belt, harness, backpack, etc.) or other object. The clip 106, when fastened to another object or person, allows the flashlight 100 to point ahead without being held by a user, allowing the light 102 to provide forward light and lights 104 to provide downwards light to illuminate a pathway. In other embodiments, the flashlight 100 may include any suitable mounting device or fastener for securing the flashlight 100 to a user's clothing or other object.

The light 102 is coupled to a printed circuit board (PCB) 108. In particular embodiments, the PCB 108 is a metal core PCB. The PCB 108 is configured to connect the light 102 with the other electronic components of the flashlight 100 and to mechanically couple the light 102 to the flashlight assembly. The light 102 and the PCB 108 may be mounted on a heat sink 110. The heat sink 110 is configured to cool the light 102. In particular embodiments, the heat sink 110 is configured to cool the light 102, but not the electronics of the PCB 108. The output of the light 102 may be controlled via an electrical connection to other components of the flashlight 100.

The lights 104 are mounted on a PCB 112. The PCB 112 is configured to controls the output of the lights 104. The PCB 112 is configured to connect the lights 104 with the other electronic components of flashlight 100 and to mechanically couple the lights 104 to the flashlight assembly. In particular embodiments, the PCB 112 is not in contact with the heat sink 110 unlike the other PCBs (e.g., 108, 114). The outputs of the lights 104 may be controlled via an electrical connection to other components of the flashlight 100.

The flashlight 100 may include a switch PCB 114. The switch PCB 114 may be connected to a switch or other actuator (e.g., a user-controlled switch that allows a user to selectively turn on or off the flashlight 100 and to select a mode of operation of the flashlight 100). In particular embodiments, the PCB 114 is near the heat sink 110, but has no thermal interaction with the heat sink 110. In various embodiments, the flashlight 100 may include plastic 118 (or other suitable material) in various areas of the flashlight 100 to physically separate heat sink 110 (and/or other heatsinks) and the circuitry of the flashlight 100.

In particular embodiments, PCB 116 may be a main PCB of the flashlight 100. In some embodiments, a processing circuit may be coupled to the PCB 116 that controls the operation of the flashlight 100. In other embodiments, functions and the like of the flashlight 100 may be controlled by a processing circuit located elsewhere in the flashlight 100. Signals may be received via components connected to the PCB 114 related to a user selection or switch (e.g., a power on or off command, or a command to change the mode of operation of the flashlight 100). Instructions are then provided, for example, to the lights 102, 104 via components connected to the PCBs 110, 112.

In some embodiments, the instructions may be based on a user-selected mode of operation. A user may select a mode for the flashlight 100 related to the operation of the flashlight 100. For example, in one mode, each of the lights 102, 104 may be illuminated at a first intensity level (e.g., 100% power). In a second mode, each of the lights 102, 104 may be illuminated at a second intensity level (e.g., 50% power). In a third mode, only the lights 104 are be illuminated to illuminate a path only (e.g., light 102 is not illuminated to provide forward light). In a fourth mode, only the light 102 is illuminated to provide forward light only (e.g., lights 104 are not illuminated to provide downward light). In a fifth mode, one or more of the lights 102, 104 may be flashing lights. The modes described are merely examples of modes of operation and thus the flashlight 100 is not limited to any one or combination of such modes. Other non-limiting exemplary modes may vary the intensity of the lights 102, 104, vary the pattern of flashing or blinking of the lights 102, 104, vary which of the lights 104 (e.g., only two of the three LEDS) are illuminated, and/or the like. In some embodiments, the user may select a mode of operation from a plurality of preset modes of operation. In other embodiments, a user may specify a desired mode of operation for the flashlight 100.

While the embodiments of FIGS. 2-3 illustrate one setup of controlling operation of the flashlight 100, it should be understood that the configuration of PCBs and electronics in the flashlight 100 may be different without departing from the scope of the present disclosure.

Referring back to FIGS. 1-2, a battery cover 120 is shown at the bottom of the flashlight 100. In some embodiment, the flashlight 100 is run on batteries, and a user may insert batteries into the flashlight 100 by removing battery cover 120. The batteries may be installed through the bottom of the flashlight 100; they may be inserted into the flashlight 100 in other locations, according to other embodiments. In some embodiment, the flashlight 100 is a flashlight run on four AA size alkaline batteries. In other embodiments, any type, size, or number of batteries may be used to power the flashlight 100. The battery cover 120 assembly is shown in greater detail in FIG. 7D.

Figure 4:
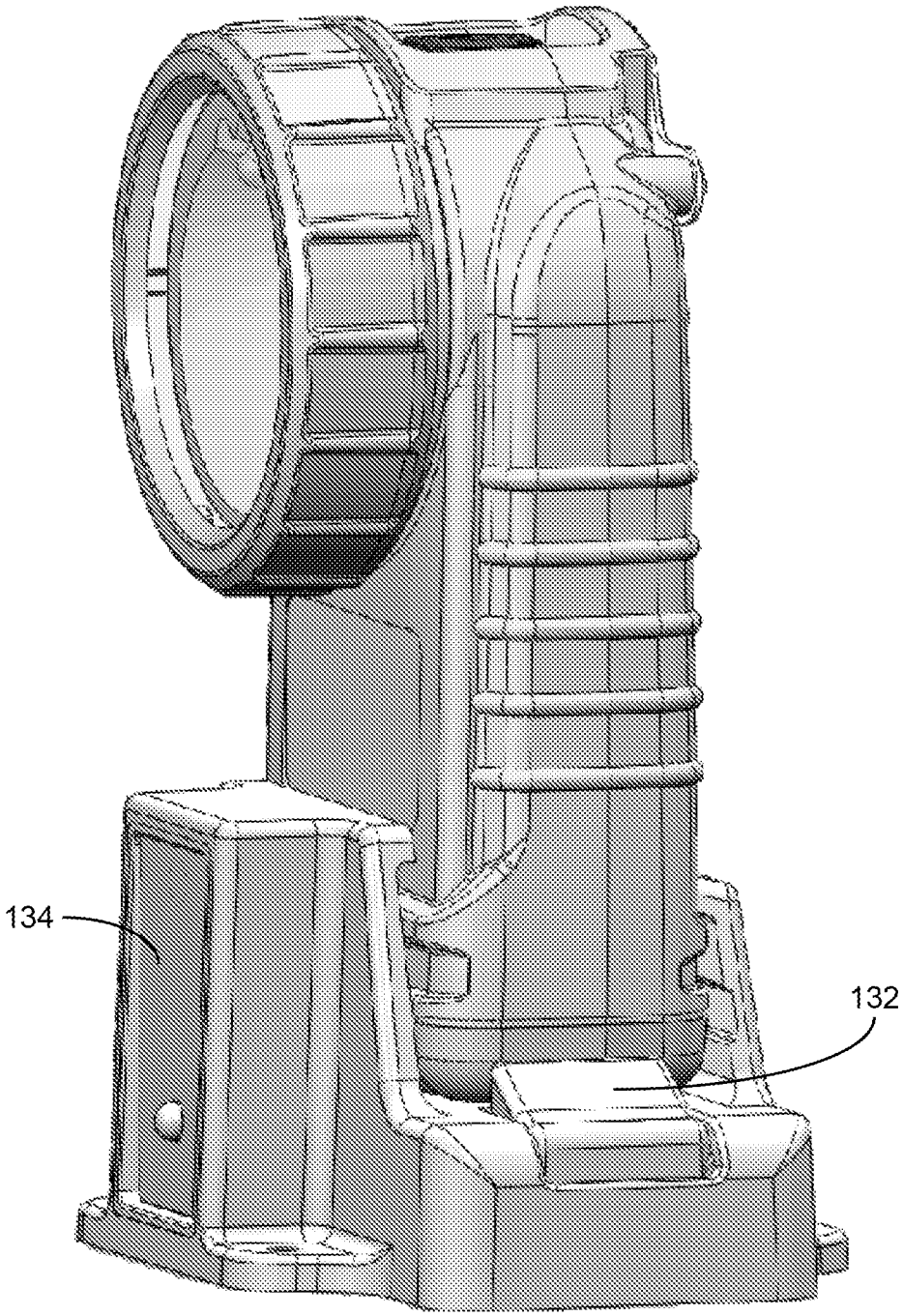
FIGS. 4-6 are illustrations of a charging system of a flashlight according to various embodiments of the disclosure.
Figure 5:
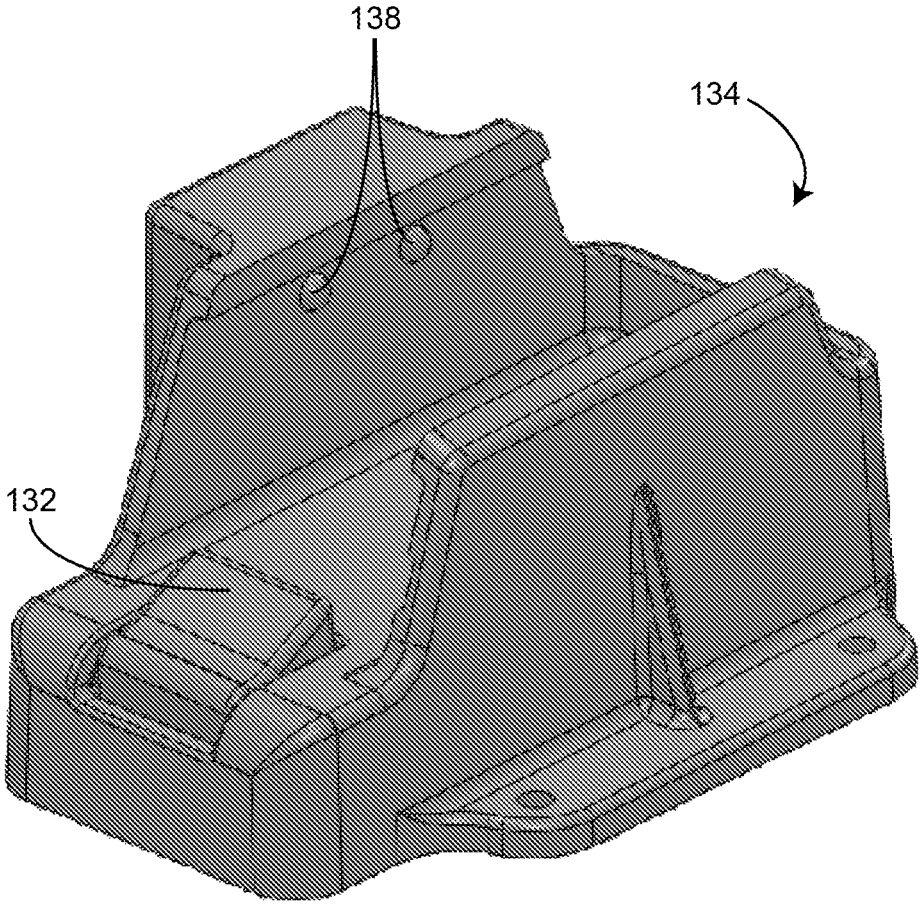
Figure 6:
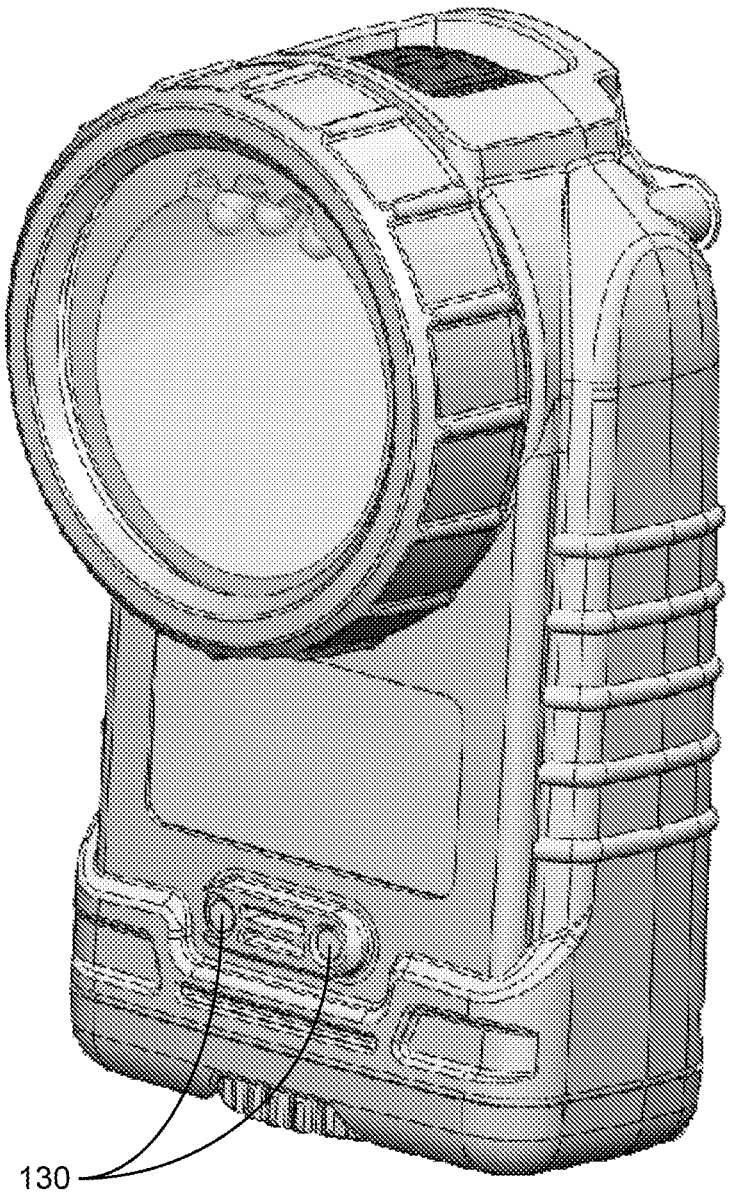

Referring now to FIGS. 4-6, a charging system for the flashlight 100 is shown. In various embodiments, the flashlight 100 may be a rechargeable flashlight. In particular embodiments, the flashlight 100 is a flashlight run on four AA size Ni-MH batteries. The flashlight 100 includes charging pins 130 on the housing of the flashlight 100 that allows the batteries to be charged by a charging unit 134 without removing the batteries from the body. The charging pins 130 are electronically coupled to the batteries of the flashlight 100 housed within the flashlight 100. In other embodiments, the batteries are removable from the flashlight 100 for charging by the charging unit 134.

According to various embodiments, the flashlight 100 may be placed in the charging unit 134 and a charger latch 132 or the like is configured to fasten the flashlight 100 in place during charging of the flashlight 100. The charger latch 132 may be pressed in order to release the flashlight 100 from the charging unit 134 by moving the charger latch 132 from a depressed state (e.g., FIG. 4) to a non-depressed state (e.g., FIG. 5). The charging unit 134 includes charging pins 138 configured to connect with the charging pins 130 to forming the connection between the power source (e.g., the batteries) of the flashlight 100 and charging unit 134.

While the present embodiments illustrate batteries as the power source of the flashlight, it should be understood that in other embodiments, other power sources may be used without departing from the scope of the present disclosure.

Figure 7A:
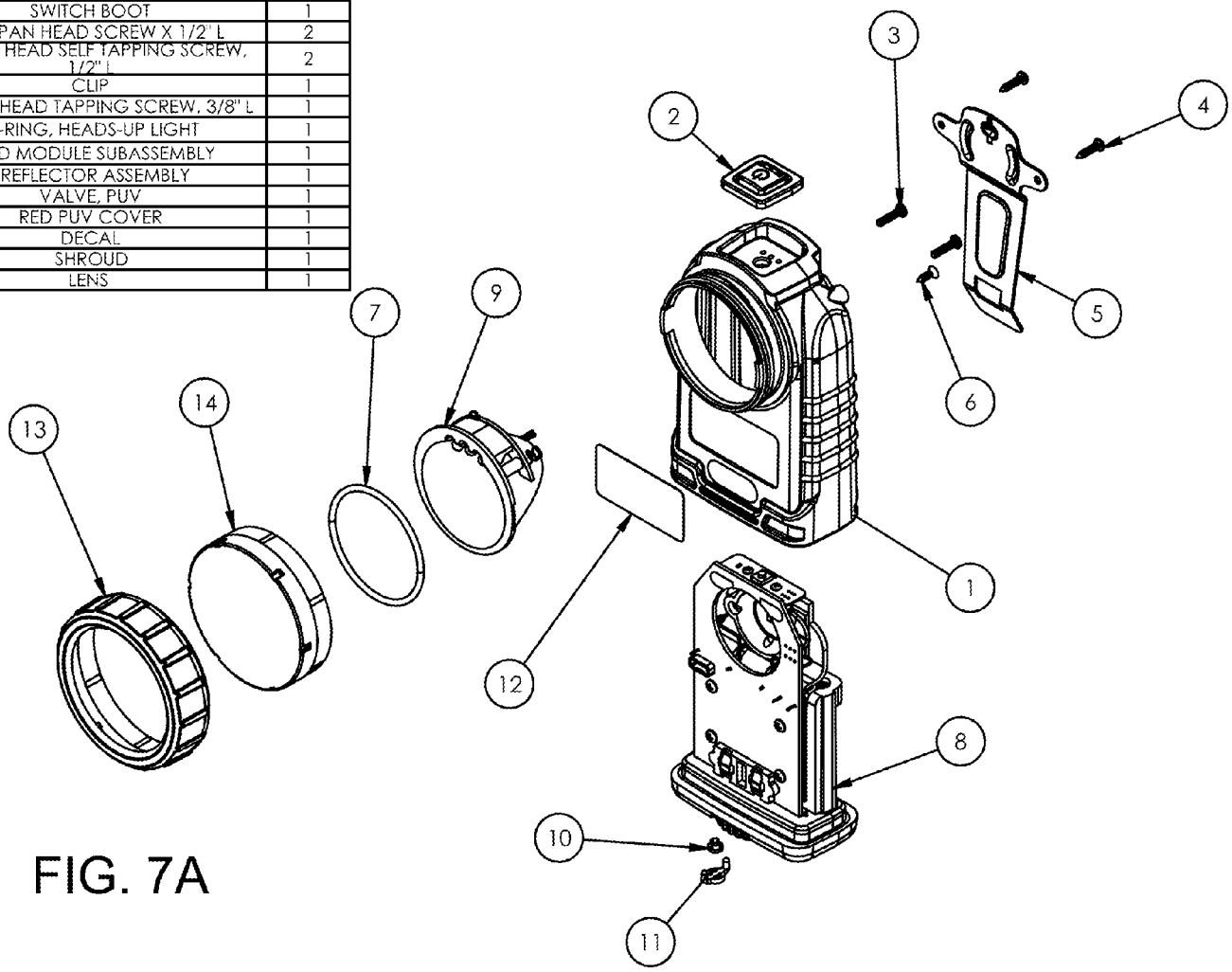

Referring now to FIGS. 7A-D, various schematic diagrams are shown that further illustrate features of a flashlight (e.g., flashlight 100 in FIGS. 1-3). Referring more particularly to FIG. 7A, a switch boot 2 (or other actuator) is shown installed at the top of a flashlight housing 1. The switch boot 2 may be operated by the user of the flashlight 100 to power on or off the flashlight 100. The switch boot 2 may further be operated by the user of the flashlight 100 to change a mode of flashlight 100 as described in the disclosure. According to various embodiments, the flashlight 100 may include other controls for allowing a user to power on or off the flashlight 100 or to change a mode of operation of the flashlight 100.

The housing 1 covers a subassembly 8 of the flashlight 100. The subassembly 8 houses or is coupled to the electronics (e.g., the PCBs, heat sinks, lights). The housing 1 may be coupled to a clip 5 via, for example, screws. The clip 5 is a clip configured to fasten to a user's clothing or other object such that the user does not need to hold the flashlight 100. The flashlight 100 further includes a lens 14 and shroud 13 covering the area of the flashlight 100 in front of a main light (e.g., light 102 of FIGS. 1-3) and a reflector assembly 9 to hold the assembly in place.

The reflector assembly 9 is shown with three notches at the top. The set of lights (e.g., lights 104) of the flashlight 100 may be held in place by the reflector assembly 9 or another component of the flashlight 100. The reflector assembly 9 includes a PCB configured to couple to the lights 104. Accordingly to various embodiments, the downcast PCB may be offset at an angle that angles the lights 104 at a 45-degree angle downwards. According to other embodiments, the downcast PCB may be offset at other angles or otherwise adjusted in order to adjust the angle at which lights 104 are downcast to provide pathway illumination. In other words, the configuration of the downcast PCB on the reflector assembly 9 determines the angle at which lights 104 are downcast. In other embodiments, the user may manually adjust the angle of lights 104. In some embodiments, the downcast PCB of the lights 104 may be installed elsewhere in the assembly of the flashlight 100.

Referring further to the switch boot 2 of the assembly, the switch boot 2 may include a clear window for indicating a battery level status. For example, the switch boot 2 assembly may include three small LEDs mounted on the switch PCB (e.g., switch PCB 114 of FIG. 1) that is visible to a user via the clear window. A low battery level may be indicated by one LED turned on the switch PCB, a medium battery level may be indicated by two LEDs turned on by the switch PCB, and a high battery level may be indicated by three LEDs turned on by the switch PCB. In other embodiments, the flashlight 100 may include other displays for indicating a battery level and other information relating to the flashlight 100.

Figure 7B:
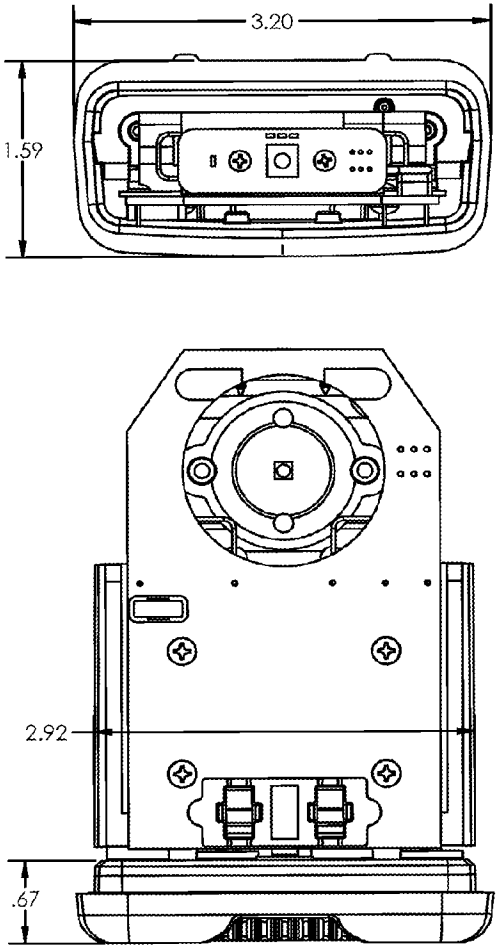
Figure 7B:
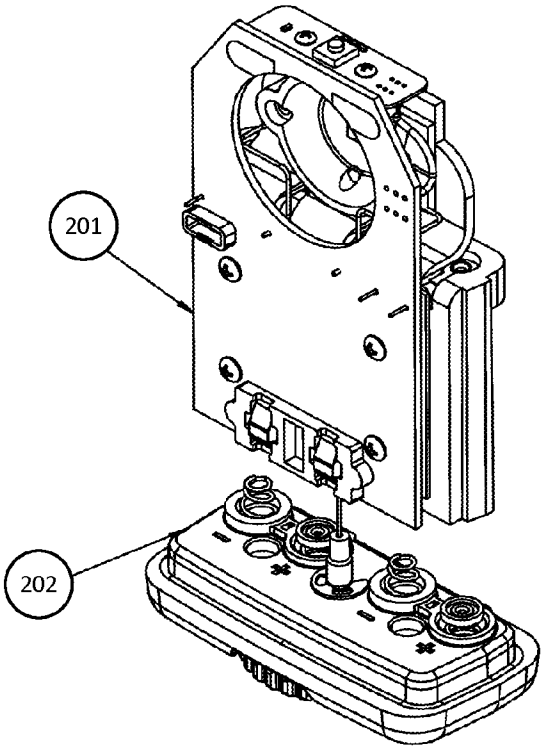

Referring now to FIG. 7B, the subassembly of a flashlight (e.g., flashlight 100 in FIGS. 1-3) is shown in greater detail. The subassembly includes a LED module assembly 201 and a battery cover assembly 202. The LED module assembly 201 houses the lights for the flashlight 100.

Referring now to FIG. 7C, the LED module assembly (e.g., 1 in FIG. 7B) is shown in greater detail. The LED module assembly includes a main PCB 314 (e.g., PCB 116 of FIGS. 2-3) connected to a wire 301 running from the main PCB 314 to a switch PCB 320 (e.g., PCB 114 of FIGS. 2-3). The assembly also includes a heat sink 302 configured to cool the LEDs of the flashlight 100 and a spacer 303 configured to physically separate the main PCB 314 and heat sink 302.

A charging contact 315 and a contact protector 316 may couple to the main PCB 314. The charging contact 315 and the contact protector 316 may be configured to provide a power source to the main PCB 314 from a battery or other power source. Also coupled to the main PCB 314 is a reflector holder 323 for holding the front assembly of the flashlight 100 together (refer to FIG. 7B).

Figure 7D:
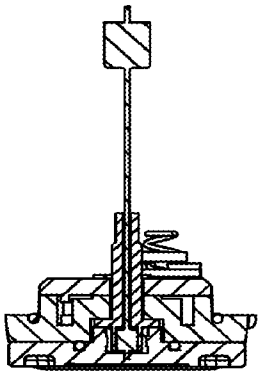
Figure 7D:
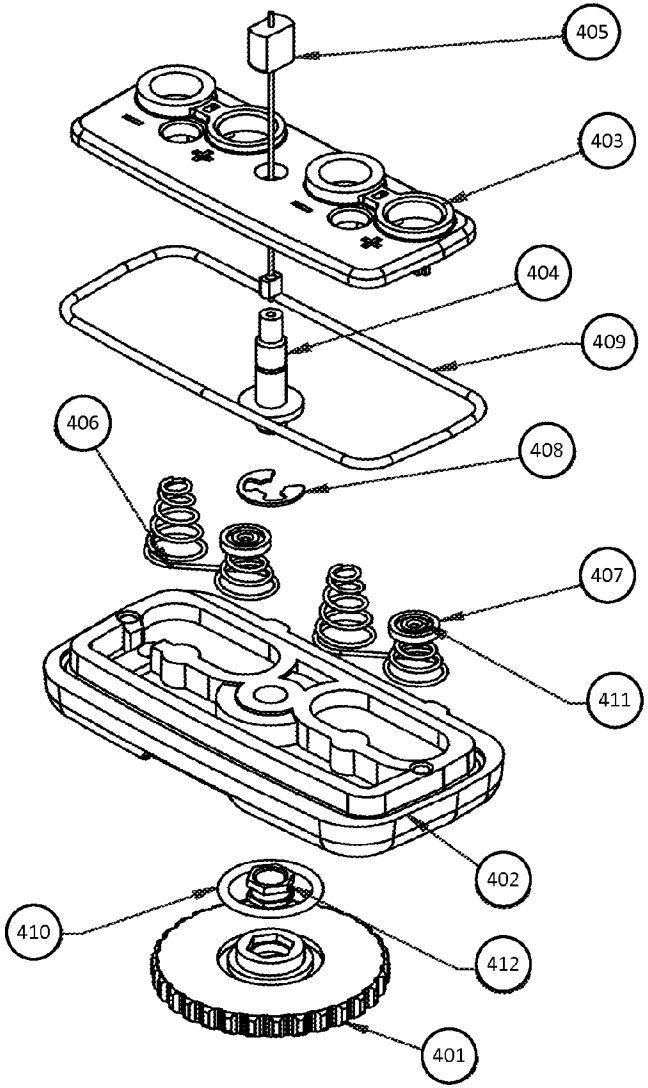

Referring now to FIG. 7D, the battery cover assembly is shown in greater detail. The battery cover assembly includes a knob 401 for opening and closing the battery cover 402 and the top battery cover 403. The knob 401 may be attached to a threaded stud and rotated until the battery cover 402 comes loose from the subassembly of the flashlight 100. The battery cover 402 may be held in place by a tether 405 to prevent the cover from coming loose and detaching from the flashlight 100.

The construction and arrangement of the systems and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements may be reversed or otherwise varied and the nature or number of discrete elements or positions may be altered or varied. Accordingly, all such modifications are intended to be included within the scope of the present disclosure. Other substitutions, modifications, changes, and omissions may be made in the design, operating conditions and arrangement of the exemplary embodiments without departing from the scope of the present disclosure.

What is claimed is:

1. A flashlight comprising:

a housing, the housing comprising a back surface facing opposite to a first direction, the back surface having a longitudinal dimension extending from a first end of the housing to a second end of the housing opposite to the first end, and a horizontal dimension perpendicular to the longitudinal dimension, wherein the longitudinal dimension is greater than the horizontal dimension;

a first light supported by the housing, the first light configured to emit light in the first direction;

a second light supported by the housing, the second light configured to emit light in a second direction that is non-parallel with the first direction;

a reflector, the reflector containing the first light and the second light, wherein the first light and the second light are received in the reflector such that the first direction and the second direction are transverse to the longitudinal dimension of the back surface;

a lens provided on the housing and facing the first direction, the lens having a diameter, wherein the horizontal dimension of the back surface is greater than the diameter of the lens;

a clip extending along the longitudinal dimension of the back surface; and an actuation switch configured to selectively power the first light and the second light when a battery is received in the housing.

2. The flashlight of claim 1, wherein the second direction is angled at between zero and 180 degrees, exclusive, to the first direction.

3. The flashlight of claim 1, wherein the second direction is angled at 45 degrees to the first direction.

4. The flashlight of claim 1, wherein at least one of the first light and the second light comprises one or more light emitting diodes.

5. The flashlight of claim 1, wherein the second light comprises a plurality of lights.

6. The flashlight of claim 1, wherein the flashlight is a right-angle flashlight.

7. The flashlight of claim 1, further comprising:

a fastening member coupled to the housing for fastening the flashlight to a user.

8. The flashlight of claim 1, wherein the first direction is substantially perpendicular to the longitudinal dimension of the back surface.

9. The flashlight of claim 1, wherein the side surface comprises a plurality of ridges.

10. The flashlight of claim 1, further comprising:

a first printed circuit board (PCB) coupled to the first light;

a second PCB coupled to the second light; and a heat sink contacting the first PCB but not the second PCB.

11. The flashlight of claim 1, wherein the horizontal dimension along the entire back surface is greater than the diameter of the lens.

12. The flashlight of claim 1, wherein the reflector faces the first direction.

13. The flashlight of claim 1, wherein the lens is provided adjacent to the reflector along the first direction.

14. The flashlight of claim 1, wherein the actuation switch is configured for selecting a mode of operation for the flashlight.

15. The flashlight of claim 14, wherein in a first mode each of the first light and the second light emit light; and wherein in a second mode only one of the first light and the second light emit light.

16. The flashlight of claim 14, wherein the actuation switch is arranged above the first light and the second light.

17. The flashlight of claim 1, wherein the reflector is a hyperbolic reflector.

18. The flashlight of claim 17, wherein the reflector reflects the light emitted by both the first light and the second light.

19. The flashlight of claim 17, wherein the reflector is arranged within the housing.

20. A flashlight comprising:

a housing;

a first light supported by the housing for emitting light in the first direction, the first light being coupled to a first printed circuit board (PCB);

a second light supported by the housing for emitting light in a second direction that is non-parallel with the first direction, the second light being coupled to a second PCB;

an actuation switch configured to selectively power the first light and the second light when a battery is received in the housing, wherein the first light and the second light are received in a same reflector; and a heat sink contacting the first PCB but not the second PCB.

21. A method of manufacturing a flashlight, the method comprising:

providing a housing, the housing comprising a back surface facing opposite to a first direction, the back surface having a longitudinal dimension extending from a first end of the housing to a second end of the housing opposite to the first end, and a horizontal dimension perpendicular to the longitudinal dimension, wherein the longitudinal dimension is greater than the horizontal dimension;

arranging a first light to be supported by the housing, the first light configured to emit light in the first direction;

arranging a second light to be supported by the housing, the second light configured to emit light in a second direction that is non-parallel with the first direction;

providing a reflector in which the first light and the second light are provided, wherein the first light and the second light are provided in the reflector such that the first direction and the second direction are transverse to the longitudinal dimension of the back surface;

providing a lens on the housing and facing the first direction, the lens having a diameter, wherein the horizontal dimension is greater than the diameter;

arranging a clip to be extending along the longitudinal dimension of the back surface; and configuring an actuation switch for selectively power the first light and the second light when a battery is received in the housing.

22. The method of claim 21, further comprising:

providing a first printed circuit board (PCB) coupled to the first light;

providing a second PCB coupled to the second light; and providing a heat sink to contact the first PCB but not the second PCB.

* * * * *